United States Patent [19]

Schuierer et al.

[11] Patent Number: 4,799,367

[45] Date of Patent: Jan. 24, 1989

[54] APPARATUS FOR THE CONTINUOUS WET TREATMENT OF A LENGTH OF TUBULAR MATERIAL

[75] Inventors: Manfred Schuierer, Michelstadt; Werner Koch, Wald-Michelbach, both of Fed. Rep. of Germany

[73] Assignee: Bruckner Apparatebau GmbH, Fed. Rep. of Germany

[21] Appl. No.: 935,927

[22] Filed: Nov. 28, 1986

[30] Foreign Application Priority Data

Dec. 18, 1985 [DE] Fed. Rep. of Germany ..... 3544837

[51] Int. Cl.[4] ..... D06B 5/08

[52] U.S. Cl. ..... 68/13 R; 68/20; 68/26; 26/85

[58] Field of Search ..... 68/20, 26, 13 R; 26/85

[56] References Cited

U.S. PATENT DOCUMENTS

| | | | |
|---|---|---|---|
| 4,155,227 | 5/1979 | Conti | 68/13 R |
| 4,266,983 | 5/1981 | Laszlo et al. | 26/85 X |
| 4,269,046 | 5/1981 | Strahm | 68/13 R |
| 4,335,593 | 6/1982 | Strahm et al. | 26/85 X |
| 4,608,767 | 9/1986 | Dornier | 68/20 |

*Primary Examiner*—Timothy F. Simone
*Assistant Examiner*—Frankie L. Stinson
*Attorney, Agent, or Firm*—Sheldon & Mak

[57] ABSTRACT

The invention relates to apparatus for the continuous wet treatment of a length of tubular material in which a changing device is provided at the inlet and the arrangement for introducing air into the length of material extends over the entire width of the chamber. Such apparatus also permits full utilization of the machine capacity even with narrow material.

10 Claims, 2 Drawing Sheets

APPARATUS FOR THE CONTINUOUS WET TREATMENT OF A LENGTH OF TUBULAR MATERIAL

The invention relates to apparatus for the continuous wet treatment of a length of tubular material.

Known apparatus of this type generally contains a plurality of chambers through which the length of material passes in succession and which have stores for the length of material (constructed for example in the shape of a boot). The length of material drawn out of the store is inflated in the individual chambers by the introduction of air into the tube so that in this way the length of material can be laid in the optimum manner and creasing can be avoided.

As a general rule lengths of material of quite different widths have to be treated in such apparatus for the wet treatment of a length of tubular material. The width of the chamber is adapted to the widest material to be treated. However, this raises certain problems if a length of narrow material is to be treated in such apparatus. In the individual chambers the length of material is stacked in the store in the form of an (at least partially) vertical stack. If the width of the material is substantially smaller than the width of the chamber, then such a narrow stack of material tends to fall over sideways.

In order to avoid this disadvantage it is known to arrange movable partitions in the individual chambers to adapt them to the particular material width and provide lateral support for a narrow stack of material. However, such a construction has the disadvantage that time-consuming movement of the partitions is necessary in order to change the machine over to another material width. A further disadvantage is the poor utilisation of the machine capacity in the wet treatment of a length of narrow material. Frequently in the treatment of a length of narrow material there is the further shortcoming of lack of uniformity (since significantly different exchange conditions occur at the edges of the narrow material from those occurring in the central region of the length of material).

The object of the invention, therefore, is to construct apparatus in such a way that it is possible to treat lengths of tubular material of different widths in a simple manner, ensuring a constant quantity of treatment and utilising the machine capacity to the full.

A changing device provided according to the invention at the inlet of the apparatus bodily shifts thelength of material from side to side over the width of the chamber and thus ensures full utilisation of the machine capacity even with narrow material. As was shown in the tests on which the invention is based, one single changing device at the inlet of the apparatus is sufficient even in the case of apparatus consisting of a plurality of chambers arranged one behind the other; the changing device is effective over the entire length of the apparatus, i.e. over all the chambers.

In the apparatus according to the invention partitions for the lateral support of narrow stacks are unnecessry. The lateral support is ensured by overlapping layers of the changed material.

In this way the storage volume of the wet treatment apparatus is fully utilised even when a length of narrow material is being treated. When the material width is reduced the machine can run at a correspondingly quicker rate in order to store the same quantity of material.

The changing of the material at the inlet of the apparatus makes certain measures necessary in order to be able to introduce air onto the length of material drawn out of the store in spite of the variable position of the length of material within the individual chambers. For this purpose according to the invention the arrangement for introducing air into the length of material extends over the entire width of the chamber. From the constructional point of view a slotted nozzle or a pipe provided with a plurality of nozzle openings can be provided for example for this purpose, so that the length of tubular material is inflated when it passes this air supply arrangement—irrespective of the position of the point at which it passes.

Several embodiments of the invention are illustrated in the drawings, in which.

Figure 1:
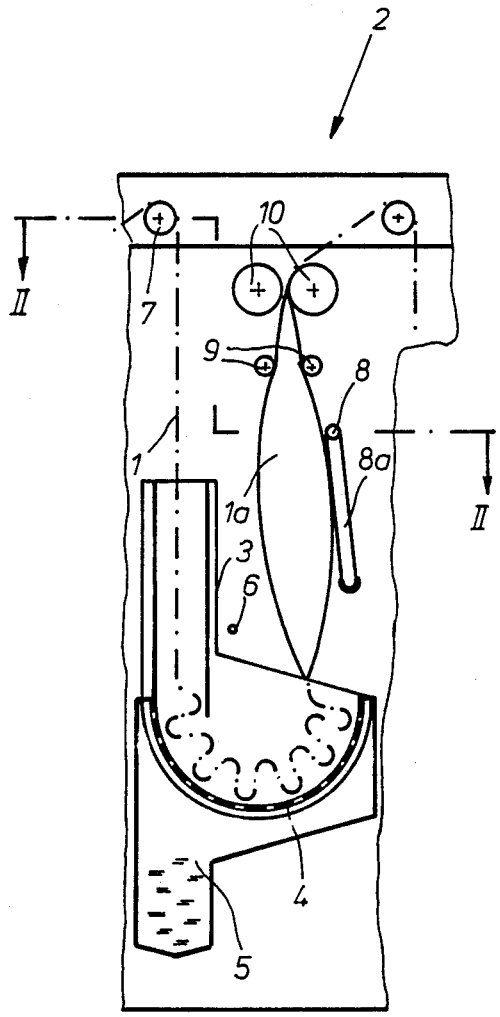
FIG. 1 shows a side view of a chamber of the apparatus according to the invention.

The apparatus for the continuous wet treatment of a length of tubular material 1 contains a large number of chambers 2, of which only one chamber is shown in FIG. 1.

The chamber 2 contains a material store 3 which is constructed in the shape of a boot, is of solution-free construction in the illustrated embodiment and is provided with a sliding grate 4.

A small bath 5 is located below the store 3. The solution is delivered for example by means of a nozzle 6.

The length of material 1 is delivered to the chamber 2 via a guide roller 7, has solution applied to it via the nozzle 6 and then passes through the store 3.

After the length of material 1 has been drawn out of the store 3 it passes through an arrangement 8 through which air is introduced into the length of tubular material and inflates it (1*a*). The arrangement 8 can be formed for example by a slotted or perforaed nozzle which extends over the whole with of the chamber 2 (at right angles to the drawing plane of FIG. 1) and is supported by a pivotable bracket 8*a* which rests on the inflated part 1*a* of the length of material 1 in the region of the nozzle.

The length of material then passes through two rollers 9 which serve to sense the size of the inflated part 1*a* and to control the supply of air via the arrangement 8. Then the length of material 1 passes through a pair of rollers 10 which hold back the air so that the length of material 1 enters the next chamber 2 as a tube which is largely free of air.

Figure 2:
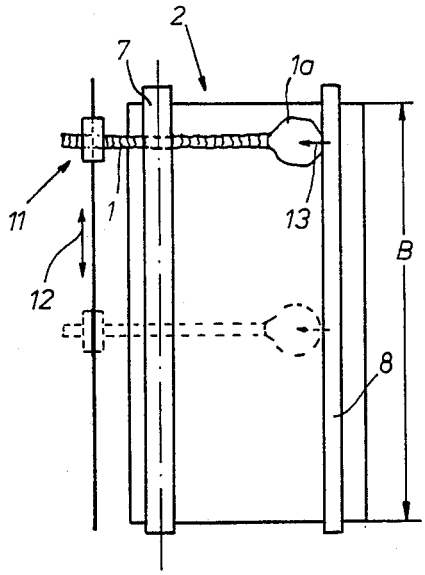
FIG. 2 shows a section along the line II—II through the chamber according to FIG. 1.

FIG. 2 shows quite schematically the changing device 11 which is arranged at the inlet of the wet treatment apparatus (it is assumed here that the chamber 2 is the first chamber of apparatus consisting of a plurality of chambers).

In the embodiment according to FIG. 2 the length of material 1 is guided in the region of the changing device 11 in the form of a hank. For this purpose the changing device 11 can be constructed for example as a ring through which the length of material 1 is passed as a hank and which is movable to and fro in the direction of the width of the chamber (arrow 12). In this way the material 1 is distributed over the entire width B of the chamber 2 (of, for instance in FIG. 2 the intermediate position of the changing device 11 which is indicated by broken lines and occurs during the changing operation).

In order for air to be introduced into the length of tubular material 1, irrespective of the particular position of the length of material, to form the inflated part 1a the arrangement 8 also extends over the entire width B of the chamber 2 so that when the length of material passes through the arrangement 8 air (arrow 13) enters the length of tubular material 1 and widens it to form an inflated part 1*a*.

Figure 3:
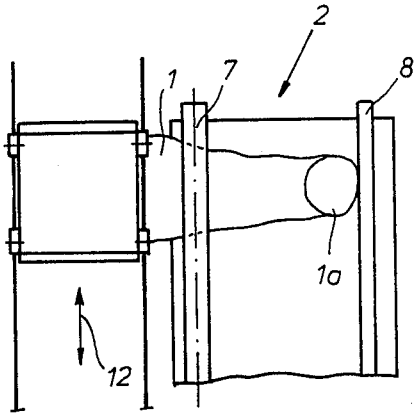
FIGS. 3 and 4 show sections (corresponding to FIG. 2) through different embodiments.

In the further embodiment which is illustrated schematically in FIG. 3 the length of material 1 is guided in the wide state in the region of the changing device 11. For this purpose the changing device contains a carriage which is movable to and fro in the direction of the width B of the chamber (double arrow 12) and delivers the length of material to the chamber 2.

Figure 4:
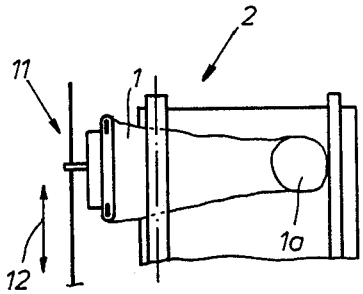

In the embodiment according to FIG. 4 the length of material 1 is guided in the region of the changing device 11 as a tube which is held in the flat state. For this purpose the changing device 11 has means for holding the tube flat which are movable to and fro (double arrow 12) in the direction of the width of the chamber 2.

We claim:

1. An apparatus for the continuous wet treatment of a length of material, wherein the apparatus has at least one accumulation chamber for storing a portion of the length of material and wherein the accumulation chamber has an accumulation chamber inlet an an accumulation chamber oulet, the apparatus comprising a changing device disposed immediately upstream of the accumulation chamber inlet, the changing device being capable of bodily shifting the entire width of the material from side to side relative to the width of the accumulation chamber inlet so as to cause the length of material to be evenly distributed within the accumulation chamber at the accumulation chamber inlet.

2. Apparatus as claimed in claim 1, characterised in that the length of material is guided in hank form in the region of the changing device.

3. Apparatus as claimed in claim 2, characterised in that the changing device contains a ring which is movable to and fro in the direction of the breadth of the chamber and through which the length of material is guided as a hank.

4. Apparatus as claimed in claim 1, characterised in that the length of material is guided in the flat state in the region of the changing device.

5. Apparatus as claimed in claim 4, characterised in that the changing device contains a carriage which guides the length of material to the apparatus and is movable to and fro in the direction of the width of the chamber.

6. Apparatus as claimed in claim 1, characterised in that the length of material is guided as a tube in the flat state in the region of the changing device.

7. Apparatus as claimed in claim 6, characterised in that the changing device has means for holding the tube flat which are movable to and fro in the direction of the width of the chamber.

8. The apparatus of claim 1 wherein the material is tubular.

9. The apparatus of claim 1 also comprising means for introducing air into the length of material downstream of the chamber.

10. The apparatus of claim 9 wherein the material is tubular and the means for introducing air into the length of material is capable of inflating a portion of the length of material.

* * * * *